US008001918B2

(12) United States Patent
Mitsui et al.

(10) Patent No.: US 8,001,918 B2
(45) Date of Patent: Aug. 23, 2011

(54) LOW-FUEL-CONSUMPTION TRANSPORT SHIP

(76) Inventors: Tetsuo Mitsui, Yamaguchi (JP); Kenzo Kawahara, Yamaguchi (JP)

( * ) Notice: Subject to any disclaimer, the term of this patent is extended or adjusted under 35 U.S.C. 154(b) by 99 days.

(21) Appl. No.: 12/466,419

(22) Filed: May 15, 2009

(65) Prior Publication Data

US 2009/0288585 A1 Nov. 26, 2009

(30) Foreign Application Priority Data

May 21, 2008 (JP) ..... 2008-133618

(51) Int. Cl.
*B63B 1/16* (2006.01)

(52) U.S. Cl. ..... 114/312; 114/273

(58) Field of Classification Search ..... 114/312, 114/61.27, 61.28, 61.29, 273
See application file for complete search history.

(56) References Cited

U.S. PATENT DOCUMENTS 4,889,066 A * 12/1989 Neil et al. ..... 114/334
5,704,309 A * 1/1998 Kohnen ..... 114/312

FOREIGN PATENT DOCUMENTS

WO WO2006/096066 * 9/2006

* cited by examiner

*Primary Examiner* — Stephen Avila
(74) *Attorney, Agent, or Firm* — Fildes & Outland, P.C.

(57) ABSTRACT

Transport ships having a relatively large structure over the water line, such as a pure car carrier, container ship and a passenger ship tend to receive the air resistance during the sailing. When sailing aslant against the wind, check helm had to be effected so far to cancel the swinging moment causing an extra increase in the underwater resistance. A low-fuel-consumption transport ship described has a structure over the water line, including a bow of a shape integral with the bridge of a hollow nearly semispherical to quarter-spherical shape or a partly cylindrical shape which is smoothly continuing to the stern to decrease the air resistance. The low-fuel-consumption transport ship further has a vertical tail incorporating a chimney and is rotatable on the uppermost stern deck to cancel the swinging moment in the air, without almost requiring check helm and, therefore, decreasing the underwater resistance.

15 Claims, 9 Drawing Sheets

( 0° )

( 0° )

( 30° )

( 30° )

( —30° )

(−30°)

LOW-FUEL-CONSUMPTION TRANSPORT SHIP

TECHNICAL FIELD

This invention relates to a low-fuel-consumption transport ship. More specifically, the invention relates to a low-fuel consumption transport ship having a relatively large structure over the water line as represented chiefly by a pure car carrier, a container ship or a passenger ship, which is designed to decrease not only the air resistance but also the underwater resistance.

BACKGROUND OF THE INVENTION

A variety of transport ships decreasing the underwater resistance have heretofore been proposed employing improved bulbous shapes at the bows in water and improving the effect correspondingly. However, no countermeasure has heretofore been made concerning the transport ships like pure car carriers, container ships and passenger ships having relatively large structures over the water line and against which the air resistance is not negligible. This fact means that it is difficult to decrease both the air resistance and the underwater resistance while giving importance to the function for holding cargoes.

PCT WO2005/100147A1 (Patent document 1) and PCT WO2005/100150A1 (Patent document 2) are concerned with equipment for utilizing the wind force by using a parachute called "sky sail" which resembles the sail of a sailing ship, and are different in objects, constitution and effects, from the present invention 1 which cancels the air resistance by aerodynamically shaping the blow portion and from the present invention 2 which decreases the underwater resistance produced by the check helm by offsetting or canceling the swinging moment that is produced when sailing aslant by utilizing the rear vertical tail which incorporates the chimney therein. Namely, the present invention is realistic and can be easily put into practice, and has a different technical idea offering the effect irrespective of the intensity of the wind force, and has inventive step irrespective of the presence of the patent documents 1 and 2.

The SHIN-AITOKUMARU (Non-patent document 1: Encyclopedia WIKIPEDIA, "Shin-Aitokumaru") was developed as a new type of sailing ship. This ship has several metallic masts erected on the deck, hangs the metallic sails therefrom, and utilizes the wind force like the sailing ship. The sails, however, are operated unattended; i.e., are automatically operated by using a computer. Though this ship may have been more advanced than the conventional sailing ships, the deck inevitably has decreased free areas, and it is difficult to find a space for installing a crane. Therefore, the technology of this non-patent document 1 could not be applied to the PCC or the container ship having large structures over the water line.

The mechanical sailing ships of this type as represented by the name SHIN-AITOKUMARU are excellent in saving energy, but several test ships are all that were ever built without, however, any successor manifesting that the transport industry interested in this type of ship.

Conventional pure car carriers, container ships and passenger ships have structures of relatively large volumes over the water line due to their needs, making it difficult to decrease the air resistance. Besides, the swinging moment of the hull produced by the air resistance must be corrected by checking the helm inevitably causing an increase in the underwater resistance while traveling. In pure car carriers and container ships, further, no consideration has been given to concentrate the steering room functions at the bow portion, which, so far, had been divided into the bridge and the front deck, as well as the anchor and the rope operation function (front deck function) necessary at the time of anchoring the hull. In the conventional transport ship, it is quite difficult to put the above task into practice.

SUMMARY OF THE INVENTION

The present invention, therefore, provides a low-fuel-consumption transport ship designed to save energy while maintaining, as a whole, the function for holding the cargoes by not only decreasing the underwater resistance relying upon the prior art technology but also forming the structure over the water line in the upper bow portion in at least a nearly hollow semispherical shape, a nearly quarter-spherical shape or a cylindrical shape, holding the bridge and the like in this portion to decrease the air resistance, providing a vertical tail of a symmetrical shape in cross section on the stern incorporating the chimney of the engine therein, the vertical tail being rotatable and adjustable and, as required, the rear end thereof working as a flap or an aileron of the front hinge, and, further, adding the leading flap to the vertical tail to cancel the swinging moment imparted to the hull by the aslant head wind or the side wind, decreasing the underwater resistance which was so far produced by the rudder adjustment (check helm), and decreasing the underwater resistance of the hull by, further, utilizing the wind force as a thrust relying upon the lift produced by the vertical tail.

According to the present invention, the bow portion is formed in one or more hollow nearly quarter-spherical to semispherical shape (inclusive of two-stepped to three-stepped round mirror shape or partly cylindrical shape) to decrease the air resistance, and a bridge is formed on the upper part thereof. In the lower part, further, a partly cylindrical front deck functional portion is provided close to the bridge in the up-and-down direction, the front deck functional portion having an opening that is usually open or that can be opened and closed as required, and having an anchor that can be accommodated by the front side surface of the hull, hanged or fixed. Further, a vertical tail incorporating a chimney therein is provided rising over the rear engine room so as to rotate about a nearly vertical axis thereof. The nearly vertically rising fixed chimney is incorporated in the vertical tail of a symmetrical shape in cross section in order to decrease the underwater resistance that is produced by the check helm for correcting the aslant sailing when receiving the aslant head wind. The vertical tail turns on a nearly horizontal plane while incorporating the chimney therein. The hollow nearly semispherical to quarter-spherical portion forming the bridge can be produced by plastically working the segmented steel boards by using a set of female and male dies having the same radius of curvature. Therefore, an advantage is that the hollow nearly semispherical to quarter-spherical portion can be easily produced in a large size or in a small size through a ship-building process by welding large or small segments together.

The bridge is of such a shape that both wings are fully stretched to both sides of the ship enabling the front deck operation to be carried our just under the bridge, i.e., facilitating the bridge operation and making it easy to manage the operation while sailing, approaching the pier, separating away from the pier, or while approaching or separating away from the side of the ship.

According to the present invention, there are provided:

A low-fuel-consumption transport ship having a structure of a small air resistance over the water line, comprising the bow of one or more hollow nearly quarter-spherical to semi-spherical shapes exposing a partly spherical vertex portion on the upper side at the front end of the bow and having a lower end of an outer diameter smaller than the width of the ship, and outer walls continuous to the front end of the bow and are extending nearly in parallel with the sides of the ship nearly up to the stern (first aspect);

The low-fuel-consumption transport ship of the first aspect, wherein the cross section of the structure over the water line in the direction of width of the ship is a cross section of a convex curve having both shoulder portions which are continuing (aspect 2);

The low-fuel-consumption transport ship of the first or second aspect, wherein the front upper portion of the bow is a bridge of such a structure that smoothly continues to the succeeding structure over the water line (aspect 3);

The low-fuel-consumption transport ship of the third aspect, wherein the front lower portion of the bridge is of a cylindrical structure having the front deck function of a structure adapted to watching the crews and to handling the gears for windlass and mooring, and being provided with windows made of a transparent glass and/or a synthetic resin that can be opened and closed, and an opening portion expanding nearly in parallel with the water line (aspect 4);

The low-fuel-consumption transport ship of the first to fourth aspects, further having a vertical tail made of a metal and/or a synthetic resin and/or a carbon fiber-reinforced material on the rear deck so as to be adjusted for its angle by a remote control (aspect 5);

The low-fuel-consumption transport ship of the fifth aspect, wherein the vertical tail incorporates a chimney nearly in the central portion thereof and is, further, provided with a leading flap and/or a trailing flap of which the angles can be adjusted with respect to the direction of the wind, the vertical tail being arranged on the rear deck (aspect 6); and The low-fuel-consumption transport ship of the fifth or sixth aspect wherein the portions of the vertical tail are adjusted for their angles by a programmed automatic control by using a computer according to a program which is prepared based on pre-collected data and has a learning capability (aspect 7).

Upon putting the invention into practice, the following effects of the invention are obtained.

(1) The air resistance can be decreased when sailing on the ocean.

(2) When sailing aslant against the wind, so far, the check helm (underwater) had to be effected to maintain the blow in the direction of sailing rather than in the direction of wind to cancel the swinging moment (yaw moment). According to the invention, however, this is done in the air by utilizing the vertical tail making it possible to cancel the underwater resistance compared to conventional ships. Besides, the lift produced by the vertical tail can be converted into a thrust of the hull.

(3) The operation is facilitated at the time of approaching the pier, separating away from the pier, approaching the side of the ship, separating away from the side of the ship, and winding the anchor up and down.

These and other features and advantages of the invention will be more fully understood from the following detailed description of the invention taken together with the accompanying drawings.

DETAILED DESCRIPTION OF THE INVENTION

Embodiments of the invention will now be described by using the drawings.

Embodiment 1

Figure 1:
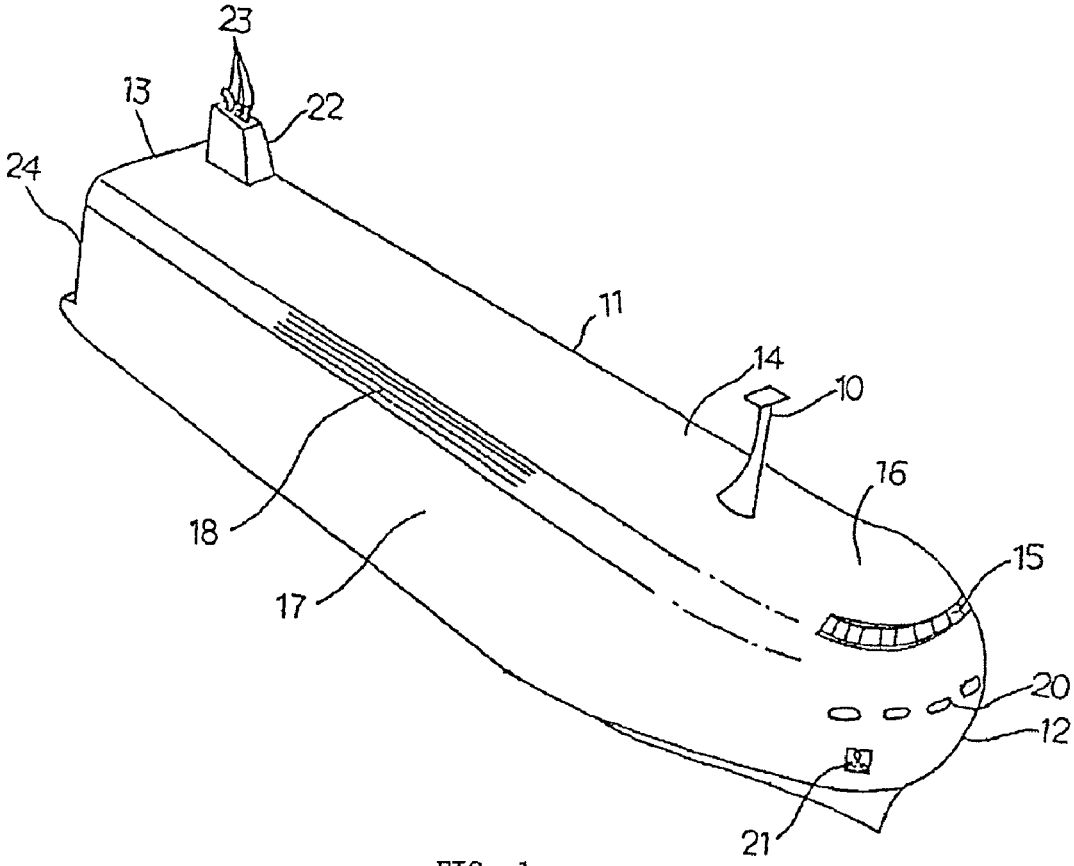
FIG. 1 is a perspective view of a pure car carrier according to an embodiment of the present invention.
Figure 17:
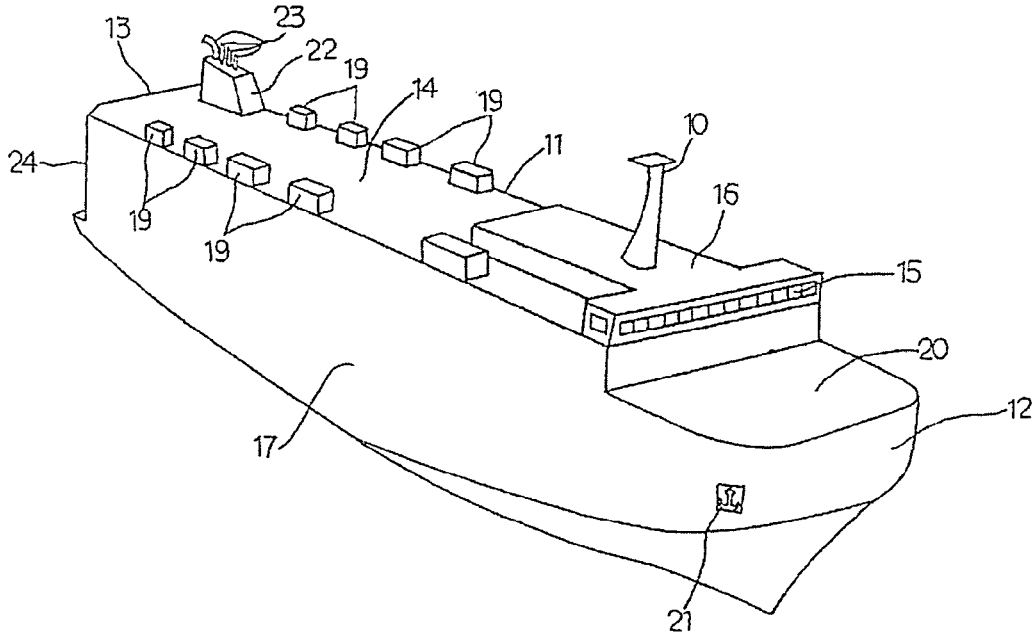
FIG. 17 (PRIOR ART)
FIG. 17 is a perspective view of the hull of the prior art (pure car carrier).

This embodiment deals with a case where the structure of the invention is applied to a pure car carrier, the structure of the invention being nearly semispherical at the bow and having the same curvature as that of the diameter of the semisphere on both sides of the uppermost deck. FIG. 1 is a perspective view of the hull of the pure car carrier according to the embodiment of the invention and FIG. 17 is a perspective view of the hull of a conventional pure car carrier.

Figure 2A:
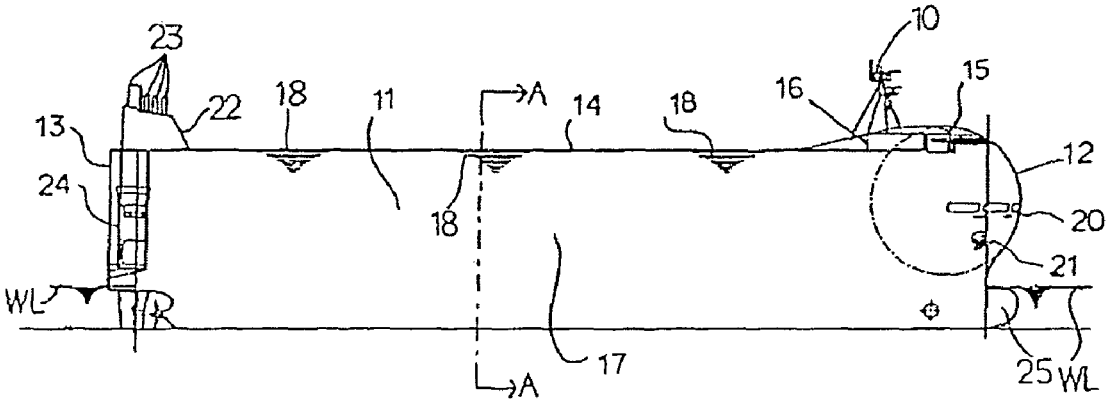
FIG. 2A is a side view of the embodiment of the invention.
Figure 2B:
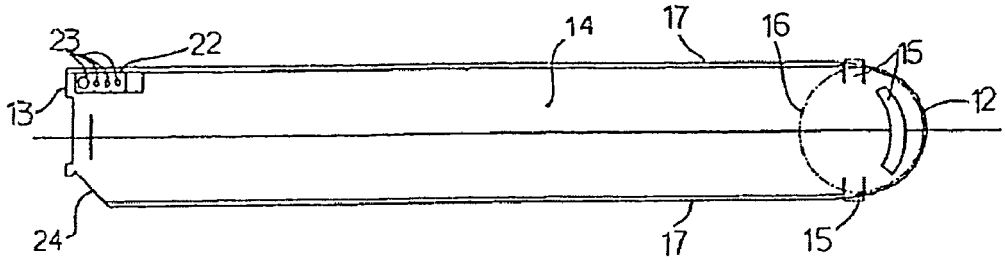
FIG. 2B is a plan view of the embodiment of the invention.
Figure 3:
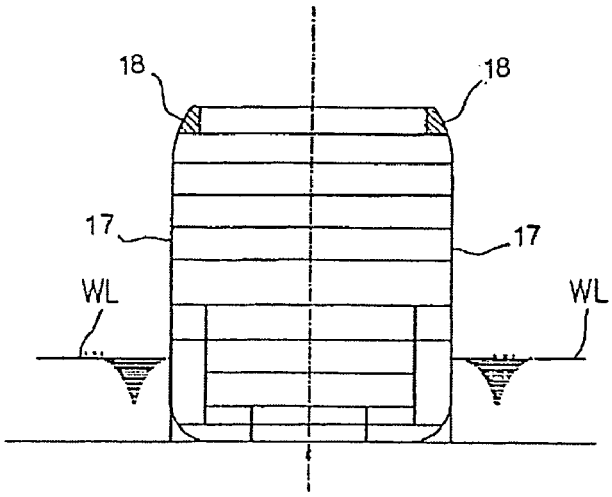
FIG. 3 is a sectional view along the line A-A in FIG. 2.

FIG. 2A is a side view of the bow of the ship of the invention, FIG. 2B is a plan view thereof, and FIG. 3 is a schematic sectional view of when both side portions of the uppermost deck is cut in the direction of width of the ship.

In the pure car carrier of this embodiment (FIGS. 2A and 2B), the semisphere has its lower end over the water line as viewed from the side surface thereof, and does not cause a change in the shape of the hull under the water level. The upper portion (domed portion) is used for arranging the bridge (steering house), and other portions are used as a section for carrying the cars. The lower portion of the bridge and the neighboring spaces are used for accommodating gears for lifting the anchor and for mooring or as a warehouse of the ship.

Referring to a hull 11 corresponding to the rear part of the semisphere in FIG. 1, the upper half portion of the sphere defines the hull of the same curvature as the diameter of the sphere, and the upper end continues to a vertex of the uppermost car deck. The upper portion over the vertex of the uppermost car deck is smoothly continuing to the ceiling of the deck from the vertex of the semisphere defining part of the bridge (steering house) and part of the dwelling section.

The lower half portion is smoothly continuing to the outer boards 17 of the hull of the rear part of the semisphere.

According to the prior art (see FIG. 17), a number of exhaust blowers 19 of deformed rectangular outer shapes are arranged on the deck on the hold. According to the embodiment of the invention (FIG. 1), on the other hand, the exhaust blowers are avoided from being entirely exposed as much as possible. Instead, an aerodynamically shaped collective exhaust louver is arranged in the round portion on the uppermost deck side. Therefore, the air resistance as a whole can be decreased yet maintaining a cargo room ventilating function.

(Wind Tunnel Experiment)

Next, the fact that the pure car carrier of the embodiment of the invention is effective in decreasing the air resistance will be described, first, based on the results of the wind tunnel experiment.

The wind tunnel experiment was conducted by using a large boundary layer wind tunnel, an experimental facility of wind engineering belonging to the Institute of Applied Dynamics, Kyushu University. The facility of wind engineering possessed a measuring dimension of 15 meters long, 3.6 meters wide, 2.0 meters high, and could produce a maximum wind velocity of 30 meters per second. By taking the width of the wind tunnel into consideration, a model ship for testing was constructed in a scale reduced to 1/75 and having a length of 1.8 mm (though the real ship possessed a water line length of 135 meters).

The following three kinds of models were used.

(1) Embodiment of the invention: Model pure car carrier applying a semisphere to the bow of the ship.

(2) Prior art: Conventional model pure car carrier.

(3) Rectangular parallelopiped block for detection by a detector.

The experiment was conducted at a wind velocity of 10 meters per second. The wind pressure produced by the wind was measured by using three component-force gauges (detectors) fixed on the floor of the experimental facility. The direction of the wind was 0° when it was from the front, and was measured every 10° up to +90° (wind from the left side) and up to −90° (wind from the right side).

The center of turn was the center of the hull.

To visualize the flow, further, the experiment was conducted by the smoking method at a wind velocity of 1.0 meter per second. The pure car carrier to be tested possessed the following principal dimensions:

Overall length: 139.9 meters
Water line length: 135.0 meters
Length between the vertical lines: 131.0 meters
Width of the ship: 22.4 meters
Depth: 29.6 meters
Draft: 6.5 meters The wind pressures obtained through the wind tunnel experiment were summarized on a hull fixing coordinate system with the center of the hull on the water plane as an origin.

Figure 10:
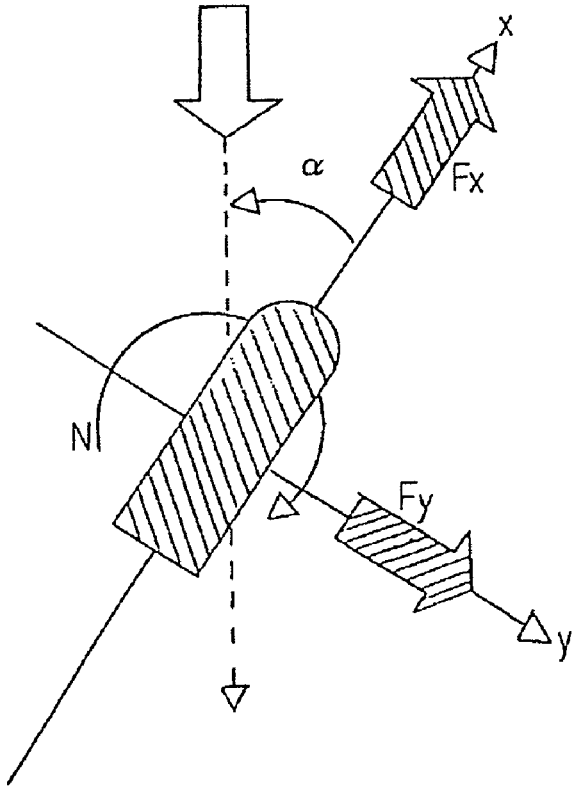
FIG. 10 is a diagram of a coordinate system used for the wind tunnel experiment and for the explanation.

The coordinate system is shown in FIG. 10.

The wind pressures were summarized by using the following dimensionless coefficients.

$C_x$: Resistance coefficient $C_x = F_x/(0.5pU^2A_F)$ $C_y$: Resistance coefficient $C_y = F_y/(0.5pU^2A_L)$ $C_N$: Swinging moment $C_N = N/(0.5pU^2A_L \cdot L)$ where, $F_x$: resistance (kg),
$F_y$: lateral force (kg),
N: swinging moment (kg-m),
p: air density ($kg \cdot S^2/m^4$),
U: wind velocity (m/s),
$A_F$: front projected area ($m^2$)
$A_L$: side projected area ($m^2$),
L: water line length (m).

The results of experiment were as described below.

Figure 14:
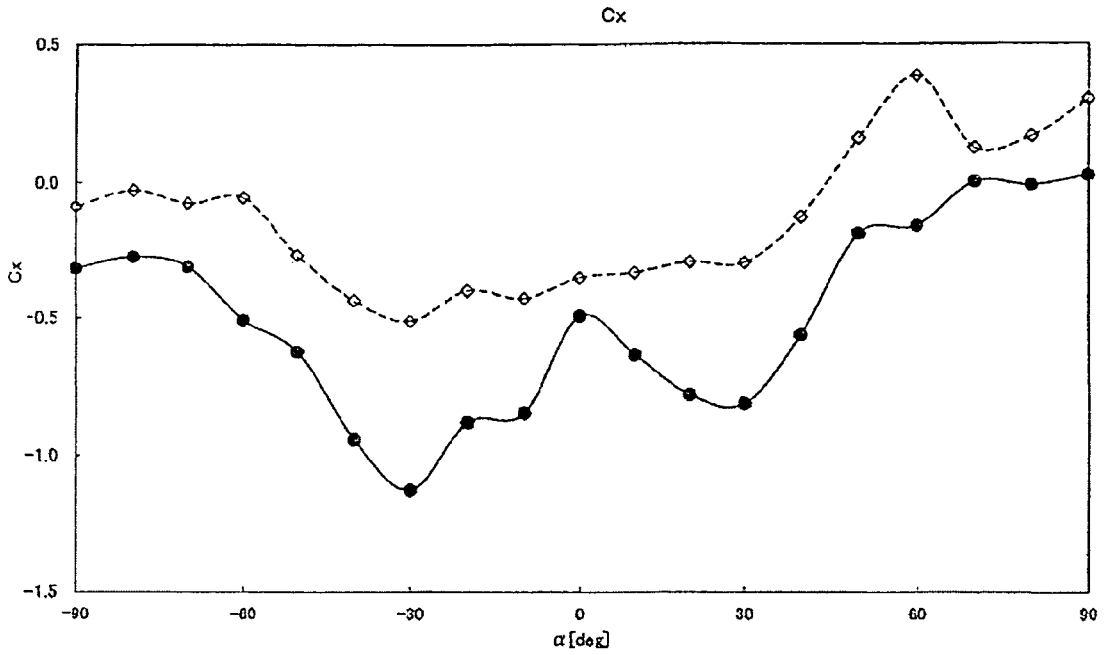
FIG. 14 is a diagram comparing the resistance coefficient $C_x$ between the invention and the prior art.

FIG. 14 illustrates the resistance coefficient ($C_x$). If the prior art is compared with the embodiment of the invention, the resistance coefficient is generally small in the embodiment of the invention. If compared between +30° and −30°, the embodiment of the invention decreases the resistance coefficient $C_x$ by 30% against the wind from the front and decreases the resistance coefficient $C_x$ by more than 50% against the wind from the aslant direction of 20° to 30°.

Comparison of α (°) $C_x$ ratio (ship of the invention/conventional ship):

| | |
|---|---|
| −30 | 0.456 |
| −20 | 0.455 |
| −10 | 0.506 |
| 0 | 0.714 |
| 10 | 0.525 |
| 20 | 0.377 |
| 30 | 0.366 |

Here, the ratios differ depending on the right side and the left side of the ship. This is because the rear right side of the hull is cut away as designated at 24 forming an open portion for the cars to be carried on board or off board when the ship has come alongside the pier. Namely, the structure of the stern is not of a symmetrical shape. That is, the right side only of the ship is exhibiting a pseudo-wing type effect.

Upon forming the bow in a spherical shape, the stream turning around the leading end exfoliates little when the wind is an aslant head wind. Further, upon aerodynamically shaping both sides of the uppermost deck, the air stream exfoliates less. Therefore, the ship of the invention encounters a generally decreased wind pressure as compared to a conventional ship.

Between 45° on the left side and 90° just beside of the ship, further, the ship of the invention gains a thrust with the plus resistance (force in the bow direction). This is because, as described above, the stern of the right side is of a structure that is cut in a triangular shape on a plan view (see FIGS. 1, 2A and 2B), and the hull is forming a wing. Therefore, no thrust is produced between −45° on the right side and −90° just beside of the ship, which is on the opposite side.

In conventional ships, the resistance is almost zero from 70° on the left side to 90° just beside of the ship, and no thrust is obtained.

Figure 15:
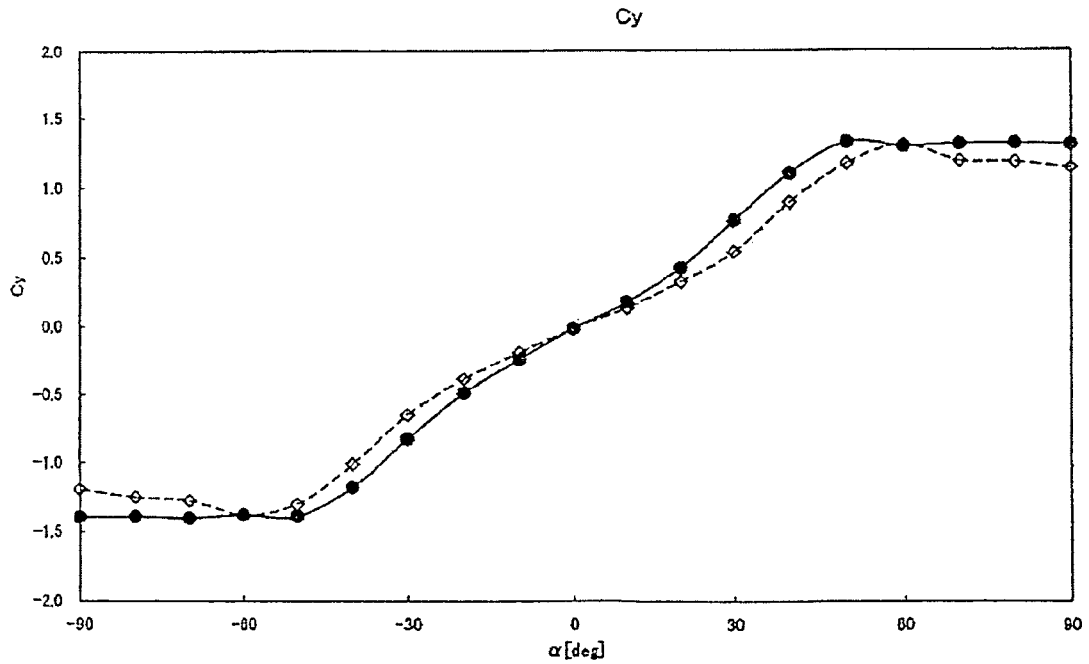
FIG. 15 is a diagram comparing the lateral force $C_y$ between the invention and the prior art.
Figure 16:
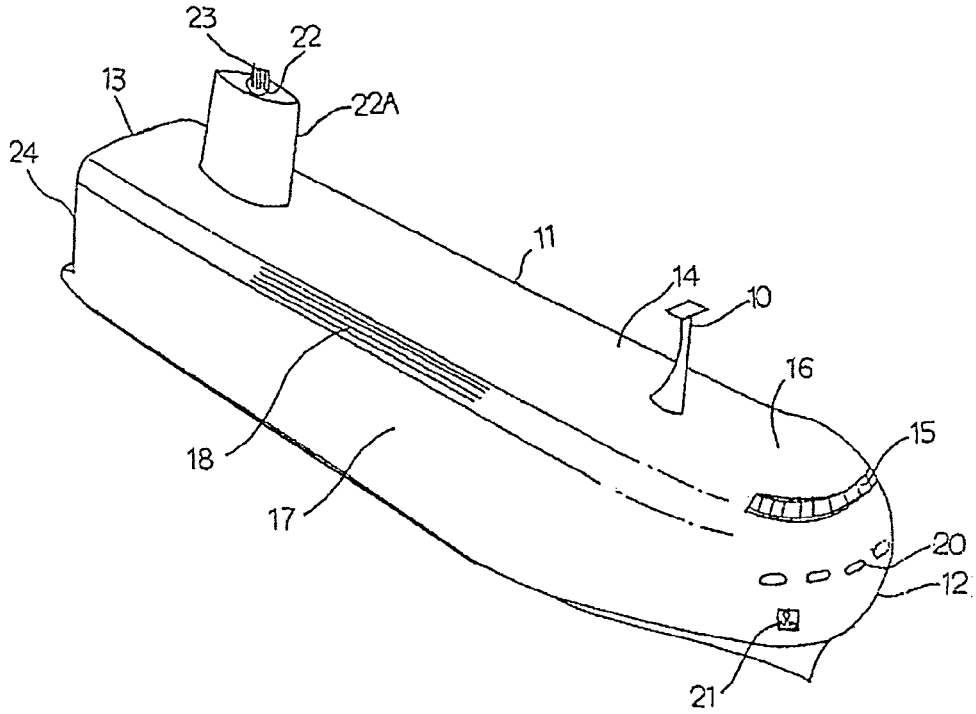
FIG. 16 is a perspective view illustrating another embodiment of the invention.

FIG. 15 illustrates the lateral force resistance coefficient ($C_y$). If the prior art is compared with the embodiment of the invention, the tendency is in agreement in general. Near +/−90° (wind from just beside), however, the ship of the invention receives the wind pressure which is smaller by about 15%.

Figure 13:
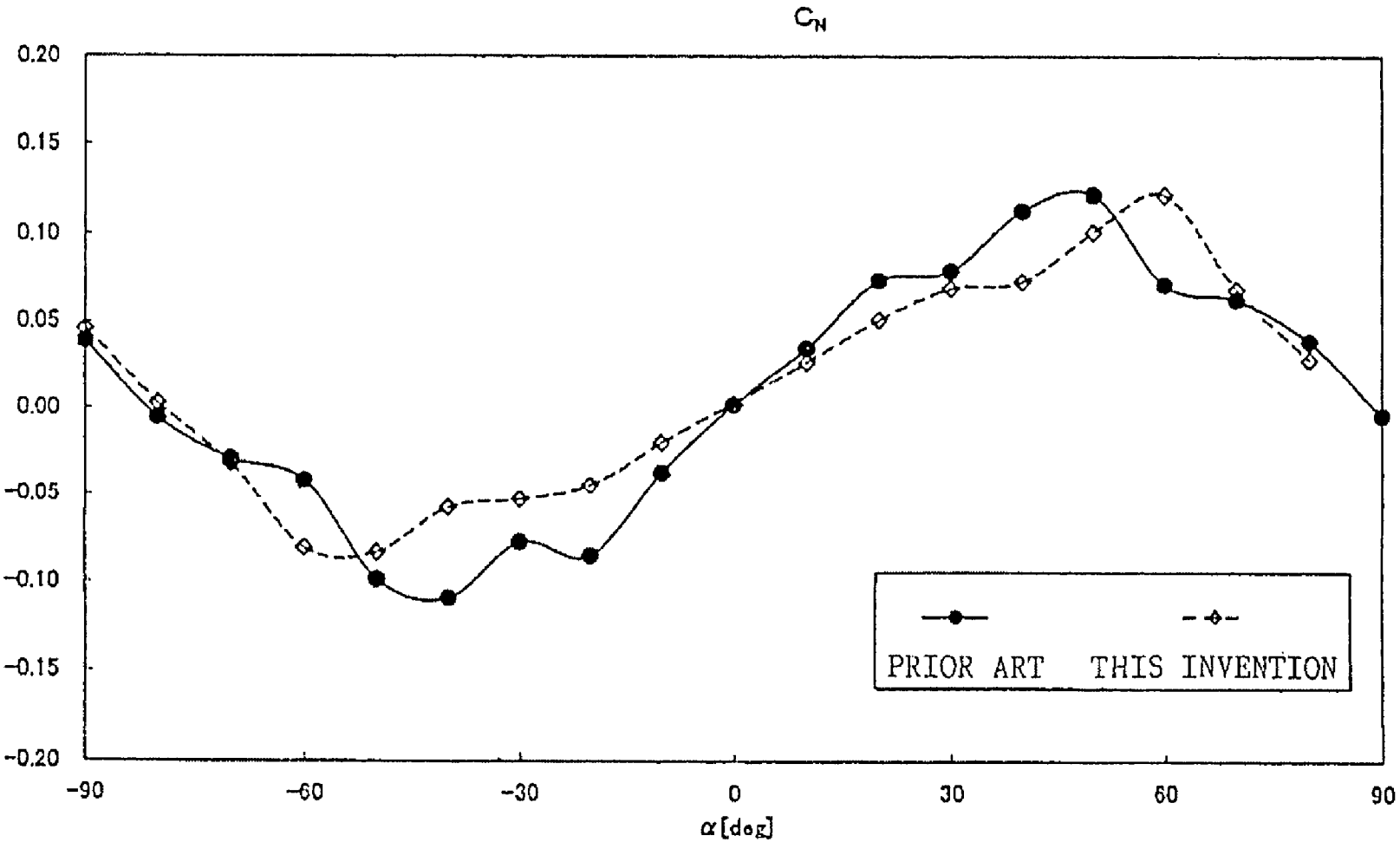
FIG. 13 is a diagram comparing the swinging moment coefficient $C_N$ between the invention and the prior art.

FIG. 13 illustrates the swinging moment coefficient ($C_N$). From 0° up to nearly +/−50°, the swinging moment in the embodiment of the invention is smaller than that of the prior art. Namely, it is allowed to decrease the amount of check helm for maintaining the course, and a decreased force of water (resistance) acts on the helm.

FIGS. 4, 5, 6, 7, 8 and 9 are still images obtained from dynamic images of a visualized record of the streams.

Figure 4:
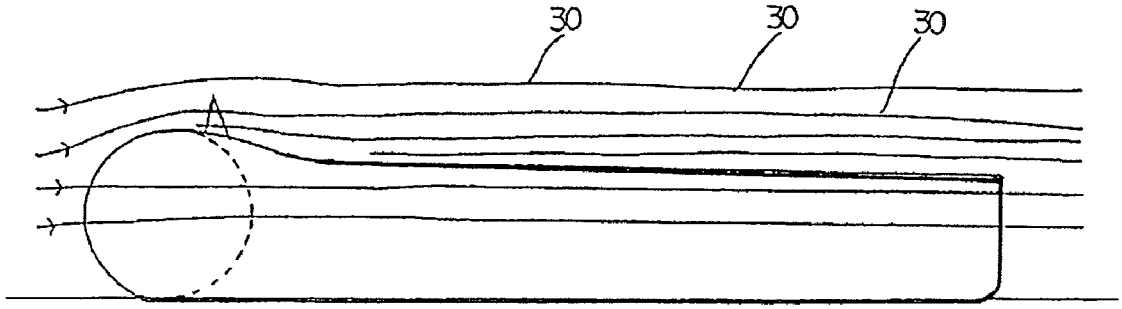
FIG. 4 is a side view of stream lines in the wind tunnel experiment according to the embodiment of the invention.
Figure 5:
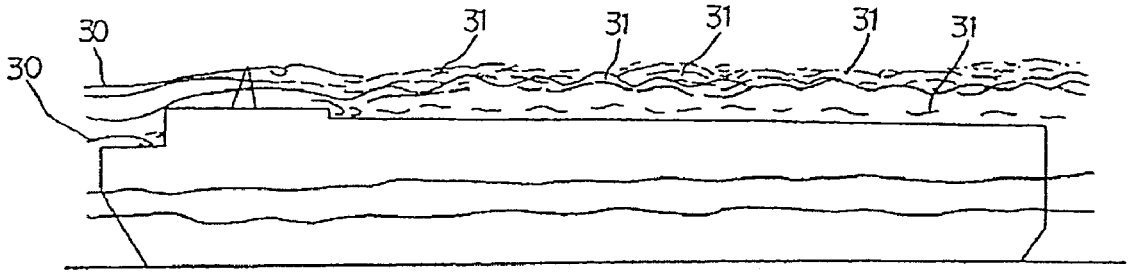
FIG. 5 (PRIOR ART)
FIG. 5 is a side view of stream lines according to the prior art.
Figure 6:
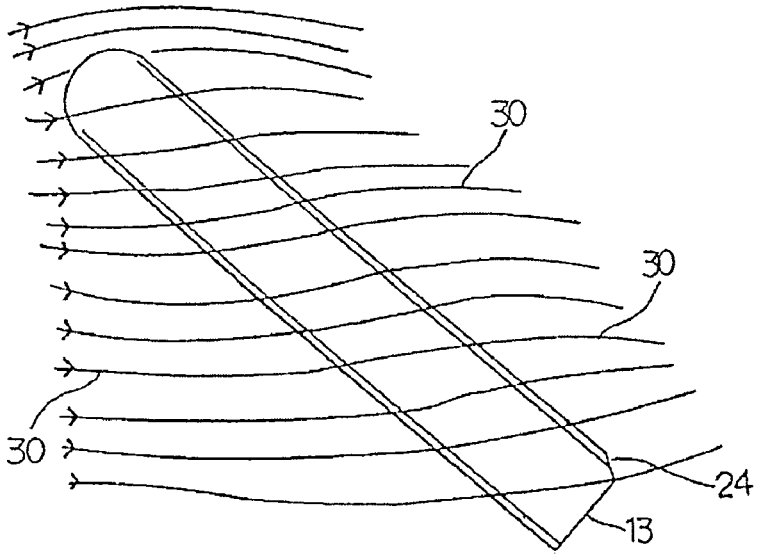
FIG. 6 is a plan view of stream lines of when the direction of wind is 30° according to the embodiment of the invention.
Figure 7:
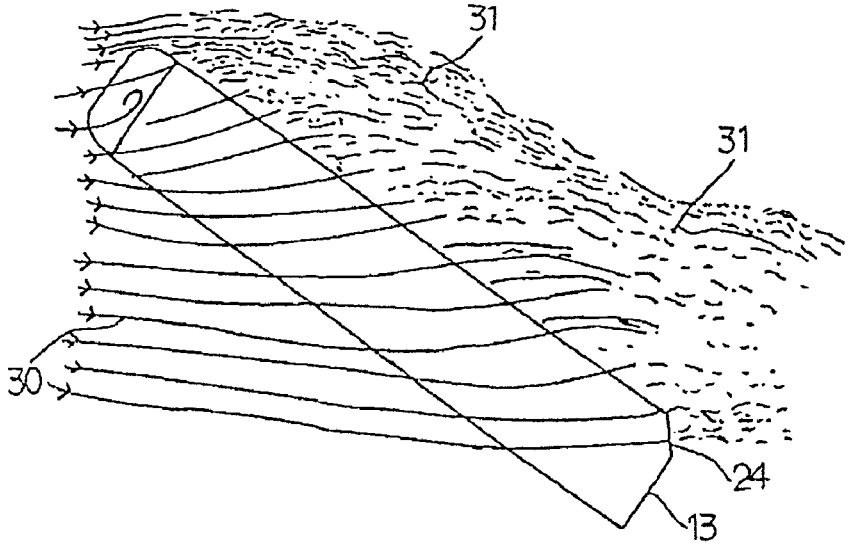
FIG. 7 (PRIOR ART)
FIG. 7 is a plan view of stream lines according to the prior art.
Figure 8:
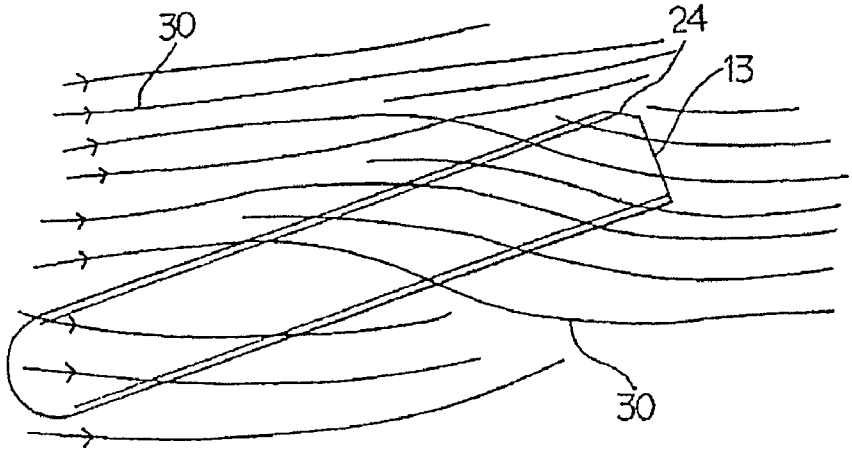
FIG. 8 is a plan view of stream lines of when the direction of wind is −30° according to the embodiment of the invention.
Figure 9:
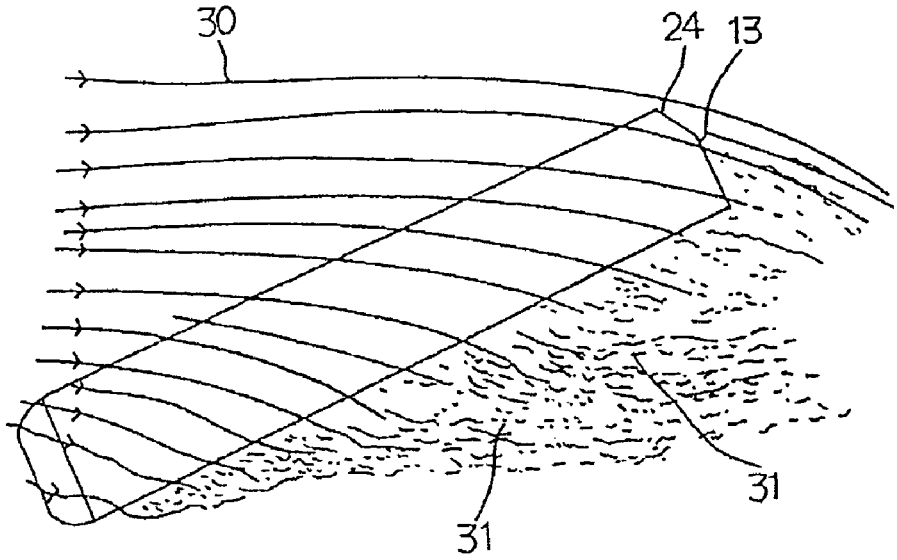
FIG. 9 (PRIOR ART)
FIG. 9 is a plan view of stream lines according to the prior art.

Against the wind from the front, the air stream flowing from the leading end of the bow to the uppermost deck differs depending upon the prior art (FIG. 5) and the embodiment of the invention (FIG. 4). In the embodiment of the invention, there is almost no turbulent flow, and the air flows smoothly along the spherical surface. In the prior art, however, the air exfoliates after having passed over the corner producing intense eddies over wide areas.

Against the aslant head wind, there is a distinct difference between the ship of the prior art and the ship of the present invention. When the wind flows from one side of the ship to the other side of the ship, the conventional ship forms a large exfoliation zone on the downstream side of the wind. The ship of the present invention, however, does not form the exfoliation zone. This difference becomes great between the conventional ship and the ship of the invention particularly when the direction of the wind is +/−30°.

Embodiment 2

According to the embodiment of the invention, the flow of air on the uppermost deck forms less exfoliation zone than the prior art. The embodiment which utilizes this nature will now be described dealing with a vertical tail 22A incorporating a chimney 22 nearly in the central portion thereof, and having a leading flap 22B and a trailing flap 23C of which the angles can be adjusted with reference to FIGS. 11, 12 and 17.

This embodiment deals with a pure car carrier of a structure having a semispherical shape at the bow and a structure of the same curvature as the diameter of the semisphere on both sides of the uppermost deck, being further equipped with the vertical tail that is remotely controlled. FIG. 1 is a perspective view of the pure car carrier of the invention.

Figure 11:
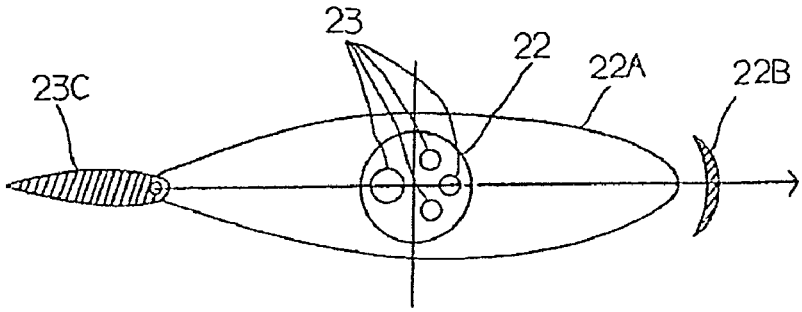
FIG. 11 is a plan view of a vertical tail (0° in the direction of bow) according to the invention.
Figure 12:
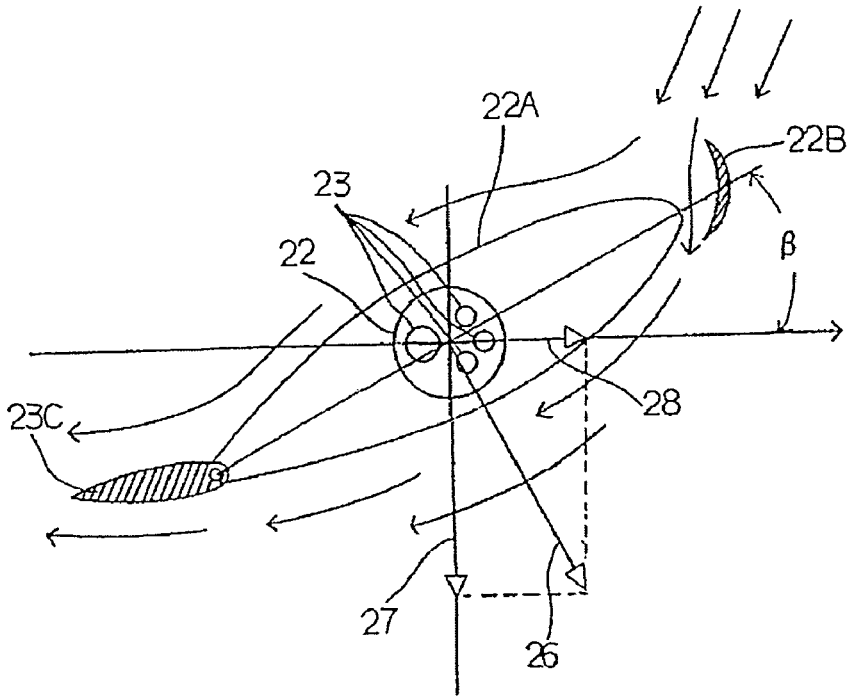
FIG. 12 is a plan view of the vertical tail (angle is adjusted to be β° with respect to the direction of the bow) according to the invention.

FIG. 11 is a plan view of when the vertical tail of the ship of the invention is provided with the leading flap and the trailing flap of which the angles can be adjusted, and FIG. 12 is a plan view illustrating the flow of the air of when the angles of the vertical tail, leading flap and trailing flap are adjusted. According to theses drawings, a lift is produced by the aslant head wind. The lift is divided into a thrust and a lateral force that works to decrease the swinging moment of the hull. The lateral force works to decrease the check helm angle and to decrease the underwater resistance caused by the check helm.

According to this embodiment, the force acting on the vertical tail is detected, and the angles of the vertical tail, leading flap and trailing flap are controlled by using a computer to obtain an optimum thrust and an optimum lateral force in the voyage.

Under the circumstances where it is a trend to save energy and to reduce $CO_2$ in the shipbuilding and ocean transport industries, the present invention makes it possible to meet the demand owing to its structure and control system by utilizing the conventional art, and brings about great advantages for the ship and vessels sailing on the oceans for long periods of time.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A low-fuel-consumption transport ship having a structure over a water line of the ship providing a small air resistance, the ship comprising a bow of one or more hollow nearly quarter-spherical to semispherical shapes over the water line exposing a partly spherical vertex portion on an upper side at a front end of the bow and having a lower end over the water line having an outer diameter smaller than the width of the ship, and outer walls continuous to the front end of the bow and extending nearly in parallel with sides of the ship nearly up to a stern of the ship, and having a vertical tail on a rear deck of the ship so as to be adjusted for its angle by a remote control, wherein portions of the vertical tail are adjusted for their angles by a programmed automatic control by using a computer according to a program which is prepared based on pre-collected data and has a learning capability.

2. The low-fuel-consumption transport ship according to claim 1, wherein the cross section of the structure over the water line in the direction of width of the ship is a cross section of a convex curve having both shoulder portions which are continuing.

3. The low-fuel-consumption transport ship according to claim 1, wherein a front upper portion of the bow is a bridge of such a structure that smoothly continues to a succeeding structure over the water line.

4. The low-fuel-consumption transport ship according to claim 3, wherein a front lower portion of the bridge is of a cylindrical structure having a front deck function of a structure adapted to watching crews and to handling gears for windlass and mooring, and being provided with windows made of one or more of a transparent glass and a synthetic resin that can be opened and closed, and an opening portion expanding nearly in parallel with the water line.

5. The low-fuel-consumption transport ship according to claim 1, wherein the vertical tail is made of one or more of a metal, a synthetic resin, and a carbon fiber-reinforced material.

6. The low-fuel-consumption transport ship according to claim 1, wherein the vertical tail incorporates a chimney nearly in a central portion thereof and is, further, provided with one or more of a leading flap and a trailing flap of which angles can be adjusted with respect to wind direction, the vertical tail being arranged on the rear deck.

7. A low-fuel-consumption transport ship having a structure of a small air resistance over a water line of the ship, the ship comprising a bow of one or more hollow nearly quarter-spherical to semispherical shapes over the water line exposing a partly spherical vertex portion on an upper side at a front end of the bow and having a lower end over the water line having an outer diameter smaller than the width of the ship, and outer walls continuous to the front end of the bow and extending nearly in parallel with sides of the ship nearly up to a stern of the ship, a front upper portion of the bow being a bridge of such a structure that smoothly continues to a succeeding structure over the water line, a front lower portion of the bridge being of a cylindrical structure having a front deck function of a structure adapted to watching crews and to handling gears for windlass and mooring, and being provided with windows that can be opened and closed, and an opening portion expanding nearly in parallel with the water line.

8. A low-fuel-consumption transport ship having a structure of a small air resistance over a water line of the ship, the ship comprising a bow of one or more hollow nearly quarter-spherical to semispherical shapes over the water line exposing a partly spherical vertex portion on an upper side at a front end of the bow and having a lower end over the water line having an outer diameter smaller than the width of the ship, and outer walls continuous to the front end of the bow and extending nearly in parallel with sides of the ship nearly up to a stern of the ship, having a vertical tail on a rear deck so as to be adjusted for its angle by a remote control, the vertical tail incorporating a chimney nearly in a central portion thereof and being further provided with one or more of a leading flap and a trailing flap of which angles can be adjusted with respect to wind direction, the vertical tail being arranged on the rear deck.

9. The tow-fuel-consumption transport ship according to claim 7, wherein the cross section of the structure over the water line in the direction of width of the ship is a cross section of a convex curve having both shoulder portions which are continuing.

10. The low-fuel-consumption transport ship according to claim 7, wherein a front upper portion of the bow is a bridge of such a structure that smoothly continues to a succeeding structure over the water line.

11. The low-fuel-consumption transport ship according to claim 10, wherein a front lower portion of the bridge is of a cylindrical structure having a front deck function of a structure adapted to watching crews and to handling gears for windlass and mooring, and being provided with windows made of one or more of a transparent glass and a synthetic resin that can be opened and closed, and an opening portion expanding nearly in parallel with the water line.

12. The low-fuel-consumption transport ship according to claim 8, wherein the cross section of the structure over the water line in the direction of width of the ship is a cross section of a convex curve having both shoulder portions which are continuing.

13. The low-fuel-consumption transport ship according to claim 8, wherein a front upper portion of the bow is a bridge of such a structure that smoothly continues to a succeeding structure over the water line.

14. The low-fuel-consumption transport ship according to claim 13, wherein a front lower portion of the bridge is of a cylindrical structure having a front deck function of a structure adapted to watching crews and to handling gears for windlass and mooring, and being provided with windows made of one or more of a transparent glass and a synthetic resin that can be opened and closed, and an opening portion expanding nearly in parallel with the water line.

15. The low-fuel-consumption transport ship according to claim 8, wherein the vertical tail is made of one or more of a metal, a synthetic resin, and a carbon fiber-reinforced material.

* * * * *